US009521883B2

(12) United States Patent
Matsumoto et al.

(10) Patent No.: US 9,521,883 B2
(45) Date of Patent: Dec. 20, 2016

(54) SLIDE FASTENER

(75) Inventors: Satoshi Matsumoto, Taipei (TW); Chih Hung Lin, Taipei (TW)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/404,054

(22) PCT Filed: May 28, 2012

(86) PCT No.: PCT/JP2012/063677
§ 371 (c)(1),
(2), (4) Date: Nov. 26, 2014

(87) PCT Pub. No.: WO2013/179377
PCT Pub. Date: Dec. 5, 2013

(65) Prior Publication Data

US 2015/0096153 A1 Apr. 9, 2015

(51) Int. Cl.
*A44B 19/34* (2006.01)
*A44B 19/12* (2006.01)
*A44B 19/04* (2006.01)

(52) U.S. Cl.
CPC ..... *A44B 19/34* (2013.01); *A44B 19/04* (2013.01); *A44B 19/12* (2013.01); *Y10T 24/2527* (2015.01)

(58) Field of Classification Search
CPC ..... A44B 19/34; A44B 19/04; A44B 19/12; Y10T 24/2527
See application file for complete search history.

(56) References Cited

U.S. PATENT DOCUMENTS 3,768,125 A * 10/1973 Frohlich ..... A44B 19/406 24/396
5,035,029 A 7/1991 Horita et al.
5,628,094 A 5/1997 Mizuno
(Continued)

FOREIGN PATENT DOCUMENTS

CA 1096144 A 2/1981
DE 2729088 A1 1/1978
(Continued)

OTHER PUBLICATIONS

Machine Translation of JP 10-313909, retreived from AIPM-JPO on Mar. 17, 2016.*
(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

There is provided a slide fastener. Each of a pair of fastener element rows is a coil-shaped fastener element row made of synthetic resin. Each of fastener elements includes an engaging head section, a first leg section and a second leg section. The first and second leg sections protrude from the engaging head section and extend parallel to each other. The first leg section comes in contact with the corresponding fastener tape and the second leg section does not come in contact with the corresponding fastener tape. The first leg section is colored in a color different from those of the fastener tapes and the second leg section. The color of the first leg section is visible through a gap between the pair of fastener tapes.

6 Claims, 7 Drawing Sheets

(56) References Cited

U.S. PATENT DOCUMENTS

| | | | | |
|---|---|---|---|---|
| 2001/0004787 | A1* | 6/2001 | Nagata | A44B 19/00 24/403 |
| 2003/0110599 | A1 | 6/2003 | Wang | |
| 2004/0088834 | A1 | 5/2004 | Yu | |
| 2006/0000067 | A1 | 1/2006 | Yoneshima | |
| 2013/0160249 | A1* | 6/2013 | Aiko | A44B 19/40 24/395 |
| 2013/0219674 | A1* | 8/2013 | Yamakita | A44B 19/12 24/381 |
| 2013/0219675 | A1* | 8/2013 | Yamakita | A44B 19/12 24/395 |
| 2015/0184277 | A1* | 7/2015 | Takeda | A44B 19/24 24/391 |

FOREIGN PATENT DOCUMENTS

| | | | |
|---|---|---|---|
| EP | 1112700 | A2 | 7/2001 |
| JP | S64-008905 | A | 1/1989 |
| JP | 02-241401 | A | 9/1990 |
| JP | 09-037817 | A | 2/1997 |
| JP | 10-313909 | A | 12/1998 |
| JP | 11-046812 | A | 2/1999 |
| JP | 11-070005 | A | 3/1999 |
| JP | 2001-178508 | A | 7/2001 |
| JP | 2006-015069 | A | 1/2006 |

OTHER PUBLICATIONS

International Search Report, PCT Application No. PCT/JP2012/063677, mailed Aug. 21, 2012.

Written Opinion, PCT Application No. PCT/JP2012/063677, mailed Aug. 21, 2012.

International Preliminary Report on Patentability, PCT Patent Application No. PCT/JP2012/063677, mailed Dec. 11, 2014.

Supplementary European Search Report, European Patent Application No. 12877881.8, mailed Apr. 1, 2016.

* cited by examiner

SLIDE FASTENER

This application is a national stage application of PCT/JP2012/063677, which is incorporated herein by reference.

TECHNICAL FIELD

The present invention relates to a slide fastener

BACKGROUND ART

As a conventional slide fastener, there is known a slide fastener in which raw materials of fastener element rows and sewing threads are colored with a pigment, the colored fastener element rows are attached to uncolored fastener tapes by the colored sewing threads, and then the fastener tapes are colored in a color different from that of the fastener element rows (e.g. Patent Document 1). In addition, as a conventional slide fastener, there is known a slide fastener in which a metallic film is formed on surfaces of upper legs of coil-shaped fastener element rows (e.g. Patent Document 2).

PRIOR ART DOCUMENT

Patent Document

Patent Document 1: Japanese Patent Application Publication No. S64-008905 A

Patent Document 2: Japanese Patent Application Publication No. 2001-178508 A summary of invention

Problems to Be Solved by Invention

In the slide fastener described in Patent Document 1, it is possible to improve coloring design properties by differentiating the color of the fastener tapes from the color of the fastener element rows to enhance contrast therebetween. However, a case where the slider fastener is used in such a manner that the fastener element rows are disposed on a back side (hereinafter, referred to as "overturned use") to exhibit the color of the fastener element rows through the gap between the right and left fastener tapes is not considered. In the slide fastener described in Patent Document 2, a case where the slider fastener is used in an overturned state to exhibit the color of the fastener element rows through the gap between the right and left fastener tapes is not also considered.

Since the overturned use of the slide fastener is typically a method that is carried out to make the fastener element rows less visible, it is preferred that the fastener element rows are not visible through the gap between the right and left faster tapes and thus the gap is minimally provided. Therefore, even though the coloring design properties of the slide fastener are improved as described in Patent Documents 1 and 2, the color of the fastener element rows is not sufficiently exhibited through the gap between the right and left fastener tapes, and thus the design properties cannot be exerted adequately. Also, Patent Documents 1 and 2 cannot obtain a light reflection effect achieved by make the fastener element rows translucent.

Accordingly, the present invention has been made keeping in mind the above described problems, and an object thereof is to provide a slide fastener, in which the color of fastener element rows can be positively exhibited through the gap between the right and left fastener tapes, thereby improving the coloring design properties of the slide fastener.

Means for Solving Problems

The object of the present invention is achieved by the following configurations.

(1) A slide fastener including: a pair of fastener tapes; a pair of fastener element rows respectively sewn to opposing tape side edge portions of the pair of fastener tapes by sewing threads, each of the fastener element rows having a plurality of fastener elements; and a slider configured to engage and disengage the pair of fastener element rows, wherein each of the fastener element rows is a coil-shaped fastener element row made of synthetic resin, wherein each of the fastener elements includes an engaging head section and first leg section and second leg section protruding from the engaging head section and extending parallel to each other, wherein the first leg section comes in contact with the corresponding fastener tape and the second leg section does not come in contact with the corresponding fastener tape, wherein the first leg section is colored in a color different from those of the fastener tapes and the second leg section, and wherein the color of the first leg section is visible through a gap between the pair of fastener tapes.

(2) The slide fastener according to (1), wherein each of the fastener element rows is a coil-shaped fastener element row made of translucent synthetic resin.

(3) A slide fastener including: a pair of fastener tapes; a pair of fastener element rows respectively sewn to opposing tape side edge portions of the pair of fastener tapes by sewing threads, each of the fastener element rows having a plurality of fastener elements; and a slider configured to engage and disengage the pair of fastener element rows, wherein each of the fastener element rows is a coil-shaped fastener element row made of translucent synthetic resin, wherein each of the fastener elements includes an engaging head section and a first leg section and a second leg section protruding from the engaging head section and extending parallel to each other, wherein the first leg section comes in contact with the corresponding fastener tape and the second leg section does not come in contact with the corresponding fastener tape, and wherein the first leg section is colored in a color different from those of the fastener tapes and the second leg section, and the second leg section is uncolored.

Advantageous Effects of Invention

According to the slide fastener of the present invention, each of the fastener element rows is a coil-shaped fastener element row made of synthetic resin, each of the fastener elements includes an engaging head section and first and second leg sections, which protrude from the engaging head section and extend parallel to each other, the first leg section comes in contact with the corresponding fastener tape and the second leg section does not come in contact with the corresponding fastener tape, the first leg section is colored in a color different from those of the fastener tapes and the second leg section, and the color of the first leg section is visible through the gap between the pair of fastener tapes. Accordingly, the color of the first leg section can be positively exhibited through the gap between the right and left fastener tapes, thereby improving the coloring design property of the slider fastener.

According to the slide fastener of the present invention, each of the fastener element rows is a coil-shaped fastener element row made of translucent synthetic resin, each of the fastener elements includes an engaging head section and first and second leg sections, which protrude from the engaging head section and extend parallel to each other, the first leg section comes in contact with the corresponding fastener tape and the second leg section does not come in contact with the corresponding fastener tape, and the first leg section is colored in a color different from those of the fastener tapes and the second leg section and the second leg section is uncolored. Accordingly, an effect that light penetrates the second translucent leg sections and then reaches to and is reflected from the first colored leg sections can be achieved, thereby improving the coloring design property of the slider fastener.

EMBODIMENTS OF INVENTION

Hereinafter, embodiments of a slide fastener according to the present invention will be described in detail with reference to the accompanying drawings.

(First Embodiment)

A first embodiment of a slide fastener according to the present invention will be first described with reference to FIGS. 1 to 5. In the following description, as for slide fastener, a front side refers to a near side with respect to the paper surface of FIG. 1, a back side refers to a far side with respect to the paper surface of FIG. 1, an upper side refers to an upper side with respect to the paper surface of FIG. 1, a lower side refers to a lower side with respect to the paper surface of FIG. 1, a left side refers to a left side with respect to the paper surface of FIG. 1, and a right side refers to a right side with respect to the paper surface of FIG. 1. In addition, the right and left direction of the slide fastener is also referred to as a width direction. The upward-downward direction of the slide fastener is also referred to as a longitudinal direction.

Figure 1:
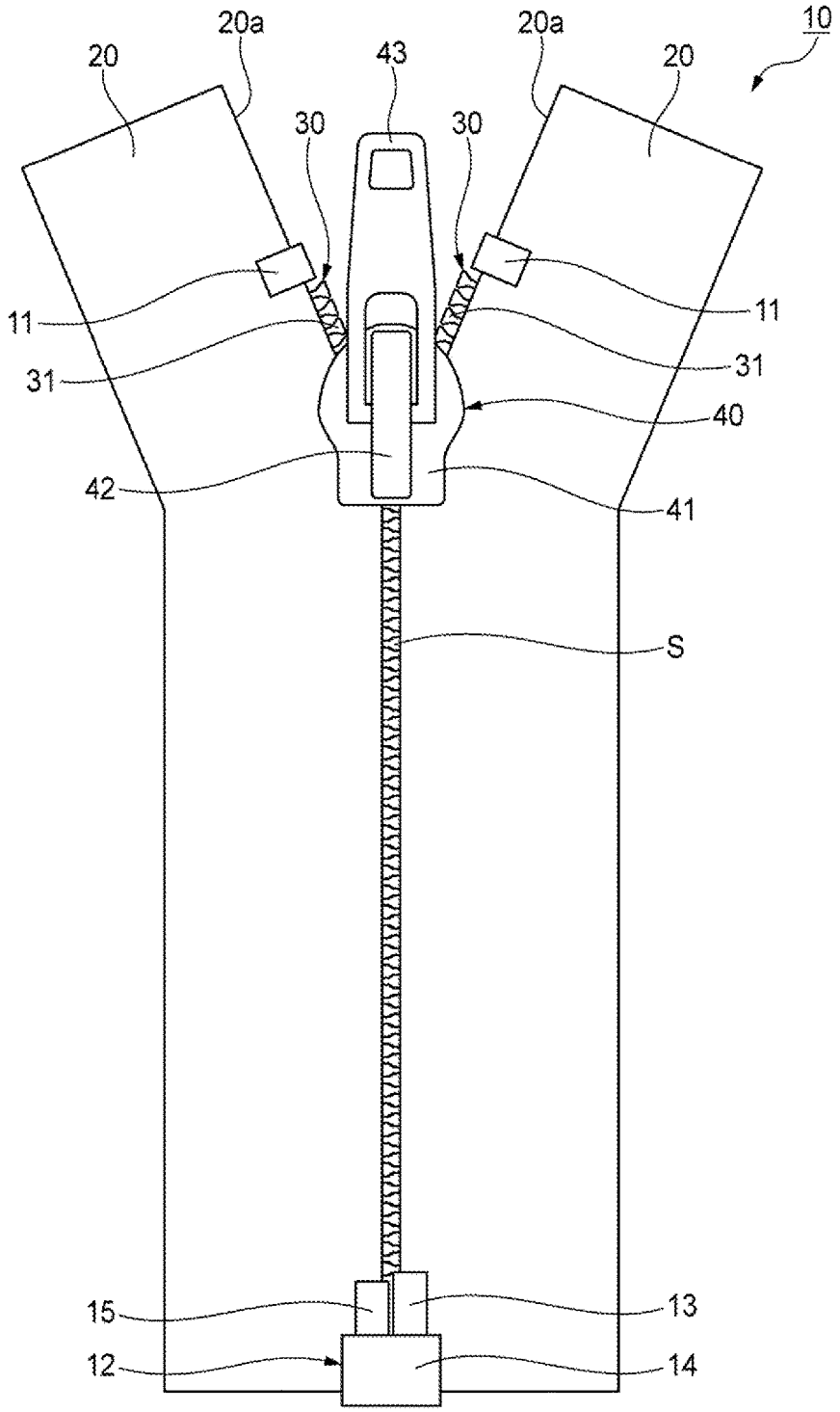
FIG. 1 is a plan view explaining a first embodiment of a slide fastener according to the present invention.

As shown in FIG. 1, the slide fastener 10 according to the present embodiment includes a pair of right and left woven or knitted fastener tapes 20, a pair of right and left fastener element rows 30 respectively provided on opposing tape side edge portions 20*a* of the pair of right and left fastener tapes 20 and each having a plurality of fastener elements 31, a slider 40 adapted to engage and disengage the pair of right and left fastener element rows 30, top end stops 11 respectively provided on upper end portions of the pair of right and left fastener element rows 30, and openers 12 respectively provided on lower end portions of the pair of right and left fastener element rows 30. In addition, the slide fastener 10 is adapted to be attached to an article, such as clothes or a bag, in such a manner that the fastener element rows 30 are disposed on a back side.

Each opener 12 includes a box pin 13 and a box body 14, which are formed on a lower end portion of the tape side edge portion 20*a* of the right fastener tape 20, and an insert pin 15 formed on a lower end portion of the tape side edge portion 20*a* of the left fastener tape 20 and adapted to be inserted into the box body 14. Alternatively, the opener 12 may be a bottom end stop.

Figure 2:
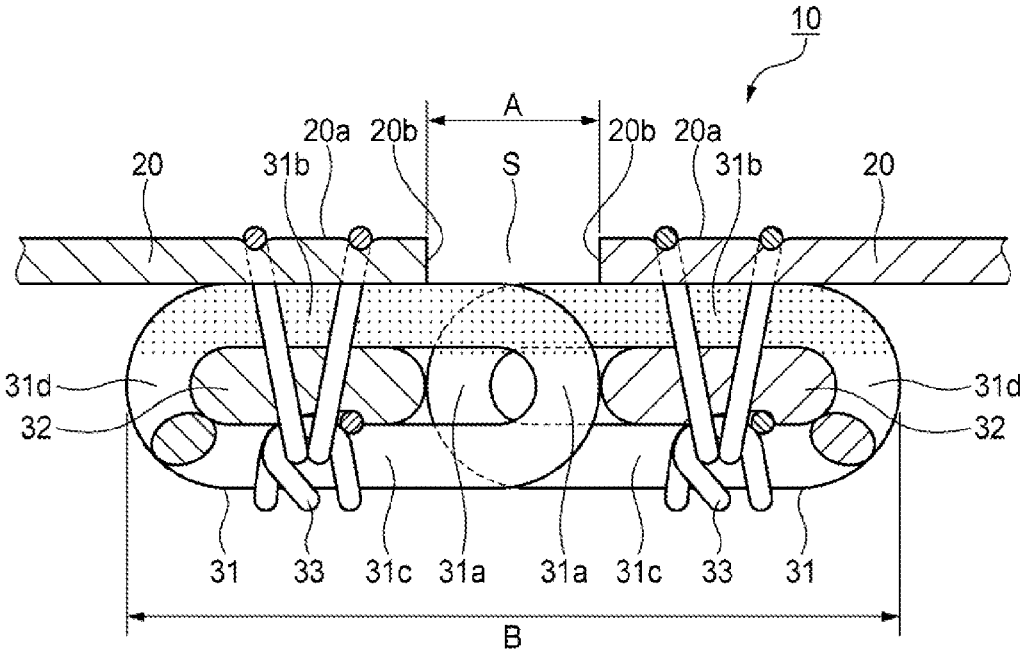
FIG. 2 is a cross-sectional view of the slide fastener shown in FIG. 1.

As shown in FIG. 2, each fastener element row 30 is a coil-shaped fastener element row which is formed by winding a monofilament made of transparent synthetic resin in a preset direction, and includes a plurality of fastener elements 31. Also, the fastener element row 30 has a core string inserted therethrough and also is sewn to a back surface (lower surface) of the tape side edge portion 20*a* of the fastener tape 20 by sewing threads 33 double-chain-stitched thereon. The synthetic resin material for the monofilament may include polyester, nylon, or the like. Although the fastener element row 30 is made of transparent synthetic resin and thus is translucent, the fastener element row 30 is not limited thereof and may not be translucent.

Each fastener element 31 includes an engaging head section 31*a* adapted to engage with and disengage from a counterpart fastener element 31, a first leg section 31*b*, which extends from one end portion of the engaging head section 31*a* outward in the width direction and comes in contact with the corresponding fastener tape 20, a second leg section 31*c*, which extends from the other end portion of the engaging head section 31*a* outward in the width direction but does not come in contact with the corresponding fastener tape 20, and a connecting section 31*d*, which connects an outer end portion, in the width direction, of the first leg section 31*b* to an outer end portion in the width direction, of the second leg section 31*c* of the adjacent fastener element 31. Thus, the first leg section 3 lb and the second leg section 31*c* are formed to protrude from the engaging head section 31*a* and extend parallel to each other.

In addition, the engaging head section 31*a*, a portion of the first leg section 31*b* and a portion of the second leg section 31*c* extend beyond a tape end 20*b* of the fastener tape 20 and are disposed on an inner side in the width direction. That is, the engaging head section 31*a*, the portion of the first leg section 31*b* and the portion of the second leg section 31*c* are disposed at positions, which are not covered by the fastener tape 20, in the front-back direction of the fastener tape 20.

As shown in FIG. 1, the slider 40 includes a body 41, a pull tab attachment section 42 provided on a surface of the body 41, and a pull tab 43 attached to the pull tab attachment section 42. By moving the slider 40 toward the top end stops 11, the pair of right and left fastener element rows 30 are engaged with each other, and by moving the slider 40 toward the opener 12, the pair of right and left fastener element rows 30 are disengaged from each other.

According to the present embodiment, the first leg sections 31*b* of a pair of right and left fastener elements 31 are colored in a color different from those of the pair of right and left fastener tapes 20 and the second leg sections 31*c* thereof, and the second leg sections 31*c* of the pair of right and left fastener elements 31 are uncolored. Specifically, the first leg sections 31*b* are colored in a color, such as silver, gold, nickel, copper or black nickel color. If the first leg sections 31*b* are colored in a light color, the fastener tapes 20 are colored in a deep color, such as black, whereas if the first leg sections 31*b* are colored in a deep color, the fastener tapes 20 are colored in a light color, such as white, thereby enhancing contrast therebetween. Meanwhile, a combination of colors can be made in any manner, and thus a combination of deep colors may be employed and also a combination of light colors may be employed.

In addition, if not translucent, the fastener elements 31 are colored in the same color as that of the fastener tapes 20 or in a color different from that of the fastener tapes 20, and the second leg sections 31*c*, which are uncolored, have a color different from that of the first leg sections 31*b* by coloring the first leg sections 31*b* in a color different from that of the fastener elements 31.

Figure 3:
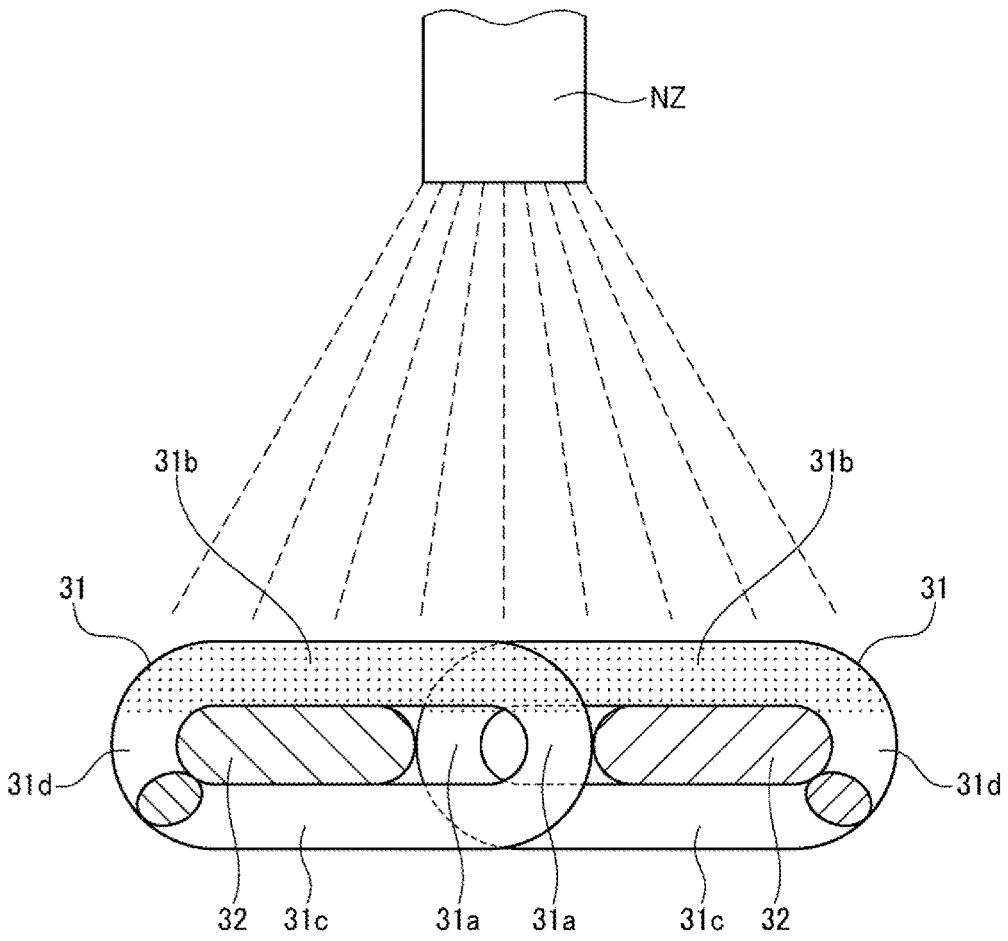
FIG. 3 is a cross-sectional view explaining a process of coloring first leg sections of right and left fattener elements.

The fastener tapes 20 and the first leg sections 31*b* of the fastener element rows 30 are colored in separate processes. Specifically, on the one hand, the fastener tapes 20 are colored by dying. On the other hand, the first leg sections 31*b* of the fastener element rows 30 is colored by plating surfaces of the first leg sections 31*b* as shown in FIG. 3. That is, a plating solution is attached on the surfaces of the first leg sections 3 lb, thereby forming a coating film thereon. A color of the coating film is different from colors of the fastener tapes 20 and the second leg portions 31*c*. Meanwhile, reference numeral NZ in FIG. 3 indicates an injection nozzle for injecting the plating solution toward the surfaces of the first leg sections 31*b*.

Also, according to the present embodiment, as shown in FIG. 2, a gap S is formed between the pair of right and left fastener tapes 20. Specifically, the tape side edge portions 20*a* of the right and left fastener tapes 20 have tape ends 20*b* which oppose each other in the width direction (the right and left direction) of the fastener tapes 20, and the gap S is formed between the tape ends 20*b*. The width dimension A of the gap S is set to be 5.4 to 25% of the width dimension B of the pair of right and left fastener element rows 30 which are engaged with each other. Thus, the color of the first leg sections 31*b* of the fastener element rows 30 is visible through the gap S from the front side of the slide fastener 10.

A description will be made below to specific examples of the width dimension A of the gap S between the pair of right and left fastener tapes 20 and the width dimension B of the pair of right and left fastener element rows 30 which are engaged with each other.

In a first example, the width dimension A ranges from 0.5 to 0 9 mm and the width dimension B ranges from 6.35 to 6.65 mm. In this case, the width dimension A is a dimension that ranges from 7.5 to 14.2% of the width dimension B. In a second example, the width dimension A ranges from 0.4 to 1.0 mm and the width dimension B ranges from 7.05 to 7.35 mm. In this case, the width dimension A is a dimension that ranges from 5.4 to 14.2% of the width dimension B.

In a third example, the width dimension A ranges from 0.35 to 0.65 mm and the width dimension B ranges from 4.0 to 4.2 mm. In this case, the width dimension A is a dimension that ranges from 8.3 to 16.3% of the width dimension B.

In a fourth example, the width dimension A ranges from 0.7 to 1.1 mm and the width dimension B ranges from 6.4 to 6.7 mm. In this case, the width dimension A is a dimension that ranges from 10 to 18% of the width dimension B. Preferably, the width dimension A ranges from 0.95 to 1.05 mm and the width dimension B ranges from 6.45 to 6.65 mm. In this case, the width dimension A is a dimension that ranges from 14 to 17% of the width dimension B.

In a fifth example, the width dimension A ranges from 0.45 to 0.55 mm and the width dimension B ranges from 4.15 to 4.35 mm. In this case, the width dimension A is a dimension that ranges from 10 to 13% of the width dimension B.

Also, in a sixth example, the width dimension A ranges from 2.35 to 2.55 mm and the width dimension B ranges from 10.5 to 11.0 mm. In this case, the width dimension A is a dimension that ranges from 21 to 25% of the width dimension B.

According to the slide fastener 10 configured as above, whether the fastener element rows 30 is translucent or not, a front surface of the slide fastener 10 is visible when the right and left fattener element rows 30 have been engaged with each other. That is, the color of the first leg sections 3 lb of the fastener element rows 30 is only visible through the gap S between the right and left fastener tapes 20. On the other hand, when the right and left fattener element rows 30 have been disengaged from each other, a back surface of the slide fastener 10 is visible through between the right and left fattener element rows 30. That is, a color of the second leg sections 31*c*, which is different from the color of the first leg sections 31*b*, is visible.

A description will be made below to a method for manufacturing the slide fastener according to the present invention.

The method for manufacturing the slide fastener 10 according to the present embodiment includes a step of supplying a pair of right and left fastener tapes 20 to a sewing machine 50, a step of supplying a pair of right and left fastener element rows 30, which are engaged with each other, to the sewing machine 50, a step of setting, at the sewing machine 50, the gap S between the pair of right and left fastener tapes 20 to a preset width dimension A, and a step of sewing, at the sewing machine 50, the pair of right and left fastener element rows 30 to tape side edge portions 20*a* of the pair of right and left fastener tapes 20, respectively.

Figure 4:
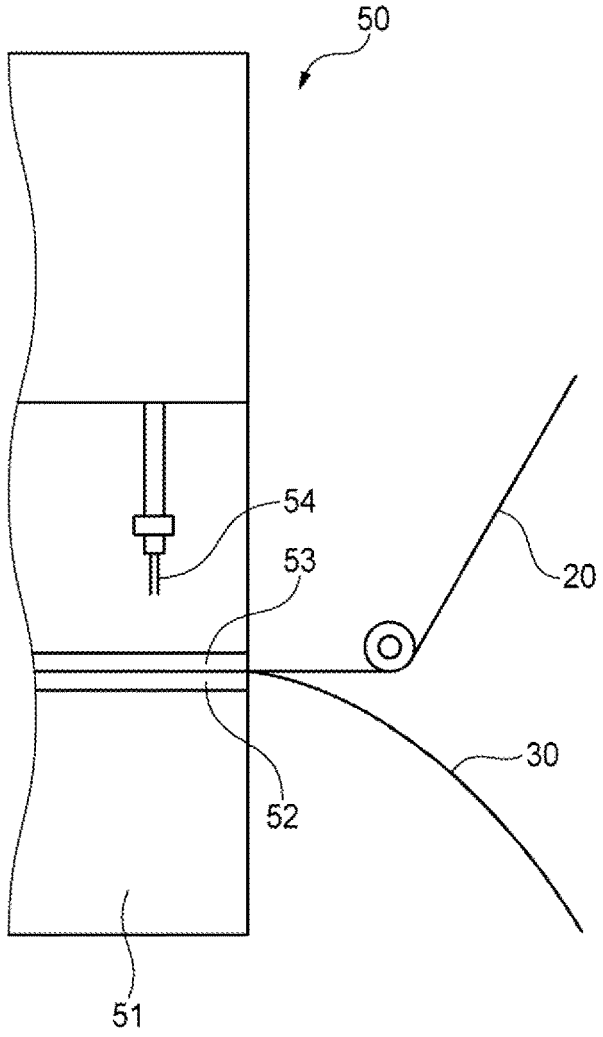
FIG. 4 is a schematic side view of a sewing machine for sewing a fastener element row to a fastener tape.
Figure 5:
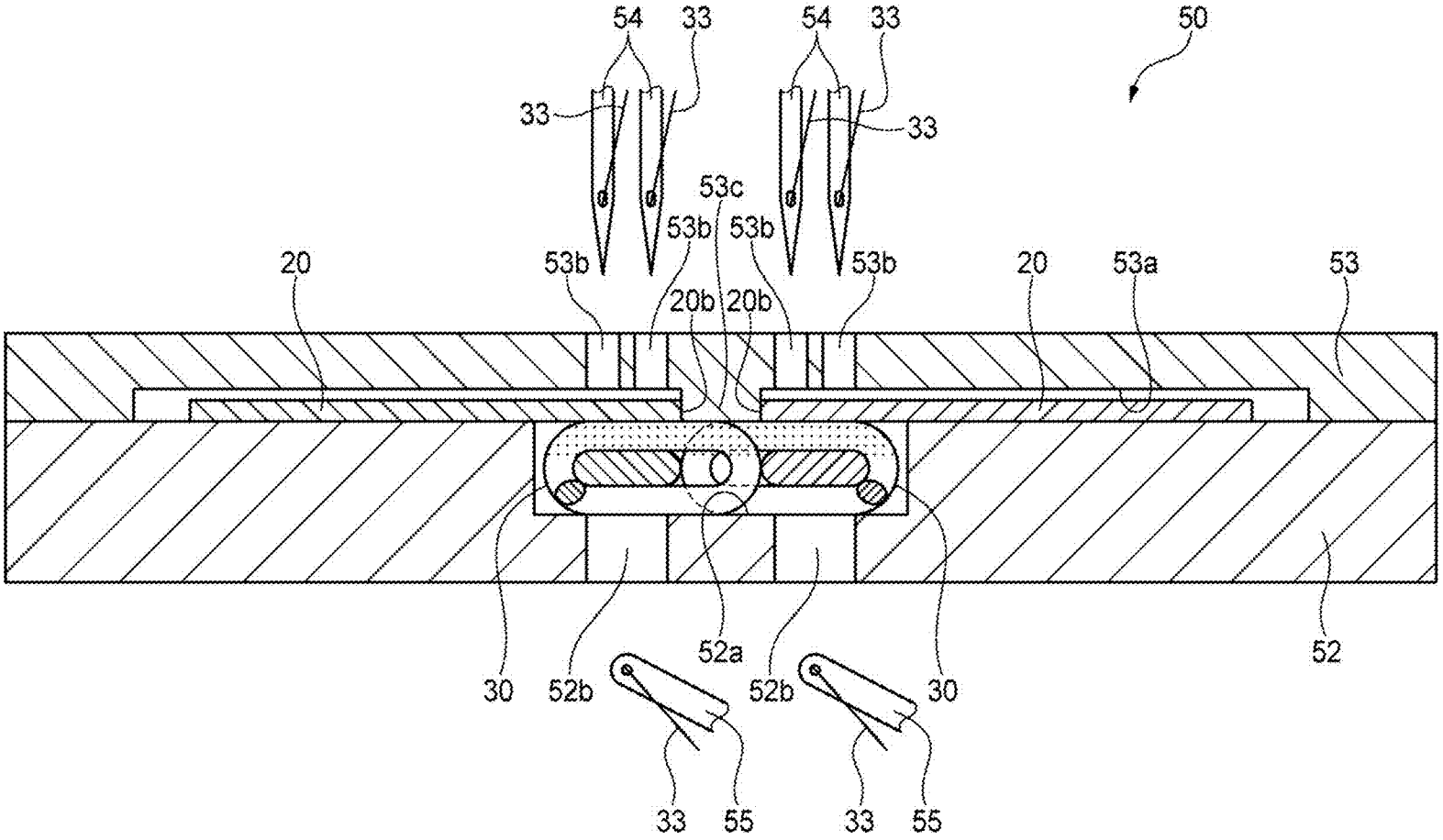
FIG. 5 is an enlarged cross-sectional view of main parts of the sewing machine shown in FIG. 4.

As shown in FIGS. 4 and 5, the sewing machine 50 includes a base 51, an element guide plate 52 attached to an upper surface of the base 51 and adapted to guide the pair of right and left fastener element rows 30 that are supplied thereto, a tape guide plate 53 attached to an upper surface of the element guide plate 52 and adapted to guide the pair of right and left fastener tapes 20 that are supplied thereto, two pair of right and left sewing needles 54, i.e. a total of four sewing needles 54 which are disposed above the tape guide plate 53, and a pair of right and left loopers 55 which are disposed below the element guide plate 52.

The element guide plate 52 has, on an upper surface thereof, an element guide groove 52*a* formed to guide the pair of right and left fastener element rows 30, which are engaged with each other, in the longitudinal direction. The element guide groove 52*a* has a pair of right and left needle through-holes 52*b* formed to extend through the element guide plate 52 in the upward-downward direction and to allow the sewing needles 54 to pass therethrough toward the element guide recess 52*a*.

The tape guide plate 53 has, on a lower surface thereof, a tape guide groove 53*a* formed to guide the pair of right and left fastener tapes 20 in the longitudinal direction. The tape guide groove 53*a* has two pairs of right and left needle through-holes 53*b*, i.e. a total of four needle through-holes 53*b* formed to extend through the tape guide plate 53 in the upward-downward direction and to allow the sewing needles 54 to pass therethrough toward the tape guide groove 53*a*. A guide section 53*c* is formed at the center of the tape guide groove 53*a* in the width direction (the right and left direction). The guide section 53*c* protrudes from the lower surface of the tape guide plate 53, and extends parallel to the tape guide groove 53*a*. The guide section 53*c* has right and left surfaces which intersect perpendicularly with the lower surface of the tape guide plate 53. The width dimension A of the gap S between the pair of right and left fastener tapes 20 is set between the right and left surfaces of the guide section 53*c*. Therefore, the width dimension of the guide section 53*c* is the same as the width dimension A of the gap S.

In the sewing machine 50 configured as above, first, the pair of right and left fastener tapes 20 are supplied to the tape guide groove 53*a* of the tape guide plate 53 and the pair of right and left fastener element rows 30 which are engaged with each other are supplied to the element guide groove 52*a* of the element guide plate 52. In subsequence, in the pair of right and left fastener tapes 20, the tape end 20*b* of the left fastener tape 20 comes in contact with the left surface of the guide section 53*c*, and the tape end 20*b* of the right fastener tape 20 comes in contact with the right surface of the guide section 53*c*. That is, the guide section 53*c* is disposed between the tape ends 20*b* of the tape side edge portions 20*a* of the pair of right and left fastener tapes 20. As the tape end 20*b* of each of the fastener tapes 20 is transported along the guide section 53*c*, the gap S between the pair of right and left fastener tapes 20 is set to the preset width dimension A. Then, the pair of right and left fastener element rows 30 are respectively sewn to the tape side edge portions 20*a* of the pair of right and left fastener tapes 20 by the two pairs of right and left sewing needles 54 and the pair of right and left loopers 55.

As described above, according to the slide fastener 10 according to the present embodiment, the first leg sections 31*b* are colored in a color different from those of the fastener tapes 20 and the second leg sections 31*c* and the color of the first leg sections 31*b* is visible through the gap S between the pair of fastener tapes 20. Accordingly, the color of the first leg sections 31*b* can be positively exhibited through the gap S between the right and left fastener tapes 20, thereby improving the coloring design property of the slider fastener 10.

(Second Embodiment)

Next, a second embodiment of a slide fastener according to the present invention will be described with reference to FIGS. 6 and 7. Meanwhile, components identical or similar to those of the first embodiment are indicated by identical reference numerals, and the descriptions thereof will be omitted or simplified. In the following description, as for slide fastener, a front side refers to a near side with respect to the paper surface of FIG. 6, a back side refers to a far side with respect to the paper surface of FIG. 6, an upper side refers to an upper side with respect to the paper surface of FIG. 6, a lower side refers to a lower side with respect to the paper surface of FIG. 6, a left side refers to a left side with respect to the paper surface of FIG. 6, and a right side refers to a right side with respect to the paper surface of FIG. 6. In addition, the right and left direction of the slide fastener is also referred to as a width direction. The upward-downward direction of the slide fastener is also referred to as a longitudinal direction.

Figure 6:
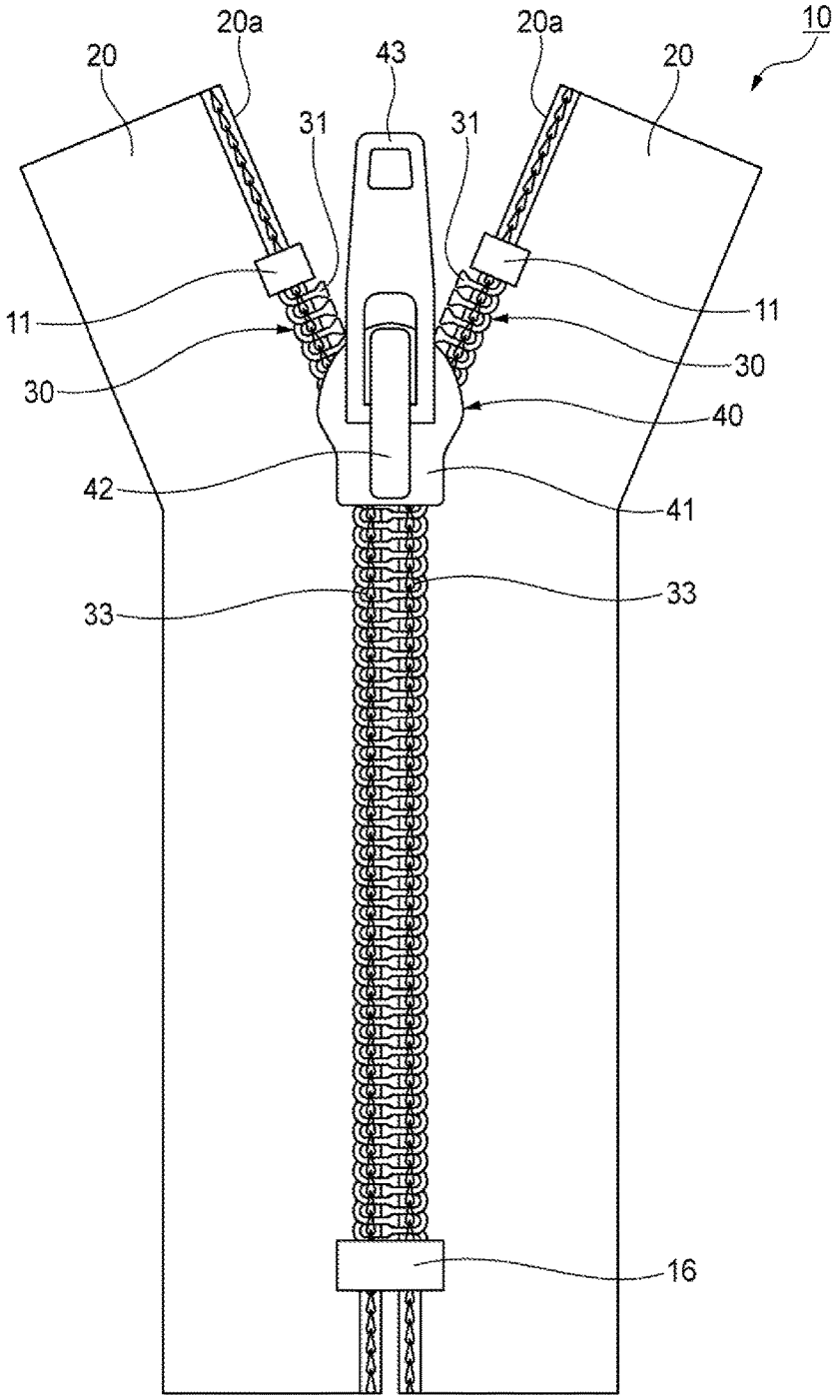
FIG. 6 is a plan view showing a second embodiment of a slide fastener according to the invention.
Figure 7:
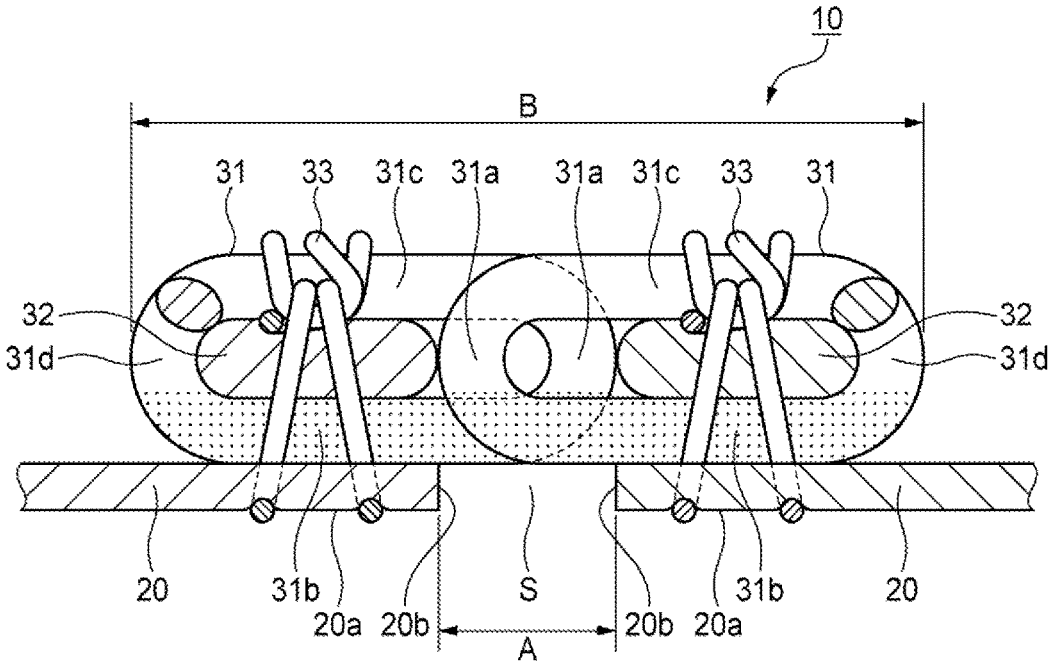
FIG. 7 is a cross-sectional view of the slide fastener shown in FIG. 6.

According to the slide fastener 10 of the present embodiment, as shown in FIG. 6, the pair of right and left fastener tapes 20 of the first embodiment is used in an overturned state so that the pair of right and left fastener element rows 30 are disposed on a front side and the slider 40 is attached thereto. Also, the present embodiment includes a bottom end stop 16 attached thereon, instead of the openers 12 of the first embodiment.

In the present embodiment, as shown in FIG. 6, first leg sections 31*b*, which are colored, are disposed on the fastener tapes 20 and second leg sections 31*c*, which are transparent and uncolored, are disposed on the front side. Accordingly, an effect that light penetrates the second transparent leg sections 31*c* and then reaches to and is reflected from the first colored leg sections 31*b* can be achieved.

As described above, according to the slide fastener 10 according to the present embodiment, the effect that light penetrates the second transparent leg sections 31*c* and then reaches to and is reflected from the first colored leg sections 31*b* can be achieved, thereby improving the coloring design property of the slider fastener 10. Also, the pair of right and left fastener tapes 20 of the first embodiment can be used in an overturned state, thereby expressing two types of design using one type of fastener tapes 20.

The other configurations and the effects thereof are identical to those of the first embodiment.

The present invention is not limited to those that were illustrated in the foregoing embodiments but can be suitably changed without departing from the concept of the present invention.

DESCRIPTION OF REFERENCE NUMERALS

10 Slide Fastener
20 Fastener Tape
20*a* Tape Side Edge Portion
30 Fastener Element Row
31 Fastener Element
31*a* Engaging Head Section
31*b* First Leg Section
31*c* Second Leg Section
33 Sewing Thread
40 Slider
S Gap

The invention claimed is:

1. A slide fastener comprising:

a pair of fastener tapes;

a pair of fastener element rows respectively sewn to opposing tape side edge portions of the pair of fastener tapes by sewing threads, each of the fastener element rows having a plurality of fastener elements; and a slider configured to engage and disengage the pair of fastener element rows, wherein each of the fastener element rows is a coil-shaped fastener element row made of synthetic resin, wherein each of the fastener elements comprises an engaging head section and a first leg section and a second leg section protruding from the engaging head section and extending parallel to each other, wherein the first leg section comes in contact with the corresponding fastener tape and the second leg section does not come in contact with the corresponding fastener tape, wherein a coating film on a surface of the first leg section colors the first leg section such that the first leg section is colored in a color different from those of the fastener tapes and the second leg section, wherein the color of the first leg section is visible through a gap between the pair of fastener tapes, and wherein the coating film on the surface of the first leg section comes in contact with the corresponding fastener tape and extends beyond the gap between the pair of fastener tapes.

2. The slide fastener according to claim 1, wherein each of the fastener element rows is a coil-shaped fastener element row made of translucent synthetic resin.

3. The slide fastener according to claim 1, wherein the second leg section is uncolored.

4. The slide fastener according to claim 1, wherein the tape side edge portions of the pair of fastener tapes are respectively provided with tape side edges which oppose each other and the gap is formed between the tape side edges uniformly in a longitudinal direction of the pair of fastener tapes.

5. A slide fastener comprising:

a pair of fastener tapes;

a pair of fastener element rows respectively sewn to opposing tape side edge portions of the pair of fastener tapes by sewing threads, each of the fastener element rows having a plurality of fastener elements; and a slider configured to engage and disengage the pair of fastener element rows, wherein each of the fastener element rows is a coil-shaped fastener element row made of translucent synthetic resin, wherein each of the fastener elements comprises an engaging head section and a first leg section and a second leg section protruding from the engaging head section and extending parallel to each other, wherein the first leg section comes in contact with the corresponding fastener tape and the second leg section does not come in contact with the corresponding fastener tape, and wherein a coating film on a surface of the first leg section colors the first leg section such that the first leg section is colored in a color different from those of the fastener tapes and the second leg section, wherein the coating film on the surface of the first leg section comes in contact with the corresponding fastener tape and extends beyond a gap between the pair of fastener tapes, and the second leg section is uncolored.

6. The slide fastener according to claim 5, wherein the tape side edge portions of the pair of fastener tapes are respectively provided with tape side edges which oppose each other and the gap is formed between the tape side edges uniformly in a longitudinal direction of the pair of fastener tapes.

* * * * *